US011511896B2

(12) United States Patent
Rädler et al.

(10) Patent No.: US 11,511,896 B2
(45) Date of Patent: Nov. 29, 2022

(54) FILLING LEVEL-INDEPENDENT GASSING

(71) Applicant: Multivac Sepp Haggenmüller SE & Co. KG, Wolfertschwenden (DE)

(72) Inventors: Michael Rädler, Kempten (DE); Florian Felch, Durach (DE); Alexander Stötzner, Kempten (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 388 days.

(21) Appl. No.: 16/440,617

(22) Filed: Jun. 13, 2019

(65) Prior Publication Data

US 2019/0382147 A1 Dec. 19, 2019

(30) Foreign Application Priority Data

Jun. 14, 2018 (DE) ..... 10 2018 114 263.3

(51) Int. Cl.
*B65B 31/00* (2006.01)
*B65B 9/02* (2006.01)

(52) U.S. Cl.
CPC ..... *B65B 31/006* (2013.01); *B65B 9/02* (2013.01)

(58) Field of Classification Search
CPC ..... B65B 31/006; B65B 9/02; B65B 61/06; B65B 9/04; B65B 51/14; B65B 31/028; B65B 47/00
See application file for complete search history.

(56) References Cited

U.S. PATENT DOCUMENTS 3,481,100 A * 12/1969 Bergstrom ..... B65B 31/021 53/433
3,509,686 A * 5/1970 Bergstrom ..... B65B 31/021 53/511
3,992,850 A * 11/1976 Vetter ..... B65B 31/021 53/510

(Continued)

FOREIGN PATENT DOCUMENTS

DE 2323409 C2 1/1975
DE 69917940 T2 6/2005

(Continued)

*Primary Examiner* — Thomas M Wittenschlaeger
*Assistant Examiner* — Katie L Gerth
(74) *Attorney, Agent, or Firm* — Brooks Kushman P.C.

(57) ABSTRACT

A method for operating a sealing station of a packaging machine, wherein the method may include one or more of the following steps: filling a packing volume of a package with a gas to create a desired atmosphere to a preset gassing target pressure for a finished package, wherein the packaging volume may be defined by a lower and an upper packaging material; discharging a partial amount of the gas introduced into the packaging volume from the packaging volume into a collection volume while retaining the packaging volume generated by the preceding filling, which reduces the pressure within the packaging volume; and reducing the packaging volume by moving the upper packaging material to an end position that corresponds to a desired appearance such that the pressure inside the package increases again to near the gassing target pressure. A sealing station that performs this method is also described.

19 Claims, 5 Drawing Sheets

(56) References Cited

U.S. PATENT DOCUMENTS 4,567,713 A * 2/1986 Natterer ..... B65B 31/021 53/433
4,791,775 A * 12/1988 Raque ..... B65B 31/043 53/110
6,912,828 B1 * 7/2005 Yamay ..... B29C 66/8322 53/432
8,091,322 B2 * 1/2012 Ehrmann ..... B65B 31/00 53/433
2004/0237478 A1 * 12/2004 Rossi ..... B65B 31/028 53/510
2005/0003059 A1 * 1/2005 McFarlane ..... B65B 25/067 426/404
2005/0257501 A1 * 11/2005 Natterer ..... B65B 31/028 53/432
2007/0079892 A1 * 4/2007 Cohen ..... F17C 13/025 141/105
2008/0104930 A1 * 5/2008 Sparakowski ..... B65B 7/164 53/432
2011/0072764 A1 * 3/2011 Daniek ..... B29C 66/8221 53/556
2012/0285126 A1 * 11/2012 Vaccari ..... B29C 66/131 53/510
2013/0036706 A1 * 2/2013 Vaccari ..... B29C 66/24244 53/79
2014/0020338 A1 * 1/2014 Hubner ..... B65B 59/003 53/453
2014/0260086 A1 * 9/2014 Schiavina ..... B29C 66/849 53/97
2014/0331611 A1 * 11/2014 Meyer ..... B29C 66/112 53/445
2015/0210413 A1 * 7/2015 Schiavina ..... B29C 66/83221 53/86
2015/0266600 A1 * 9/2015 Haimi ..... B67C 3/222 53/408
2016/0068288 A1 * 3/2016 Palumbo ..... B29C 65/30 53/511
2016/0304226 A1 * 10/2016 Rossini ..... B29C 65/7882
2017/0305585 A1 * 10/2017 Rizzi ..... B29C 65/30
2017/0305586 A1 * 10/2017 Rizzi ..... B29C 65/7461
2018/0222619 A1 * 8/2018 Ehrmann ..... B29C 66/131
2019/0210750 A1 * 7/2019 Enderle ..... B65B 31/028
2019/0382142 A1 * 12/2019 Felch ..... B65B 57/00

FOREIGN PATENT DOCUMENTS

DE 60123678 T2 1/2007
EP 299821 A1 1/1989
GB 1445530 A 8/1976
WO 2012100956 A1 8/2012
WO 2014056806 A1 4/2014
WO 2014180823 A1 11/2014
WO 2017102541 A1 6/2017

* cited by examiner

FILLING LEVEL-INDEPENDENT GASSING

CROSS-REFERENCE TO RELATED APPLICATIONS

This Application claims priority to German Patent Application No. 10 2018 114 263.3 filed on Jun. 14, 2018 to Michael Rädler, Florian Felch and Alexander Stötzner, currently pending, the entire disclosure of which is incorporated herein by reference.

FIELD OF THE INVENTION

The invention relates to a method for manufacturing packages with packaging appearances being at least essentially similar to one another and a sealing station for manufacturing packages with packaging appearances being essentially similar to one another.

BACKGROUND OF THE INVENTION

The present invention is based on the problem described below in conjunction with FIG. 1. FIG. 1 shows a sealing station 3' configured for gassing evacuated packages, which is available, for example, as part of a deep-drawing packaging machine. During gassing of the packages positioned inside the sealing station, if there are different product filling levels inside the respective packages, then individual packages may appear visually unequally manufactured.

According to FIG. 1, in multi-lane and/or multi-row formats, a total packaging volume P' (hereinafter also: packaging volume P') is gassed, which consists of the sum of a partial volume V1', which is composed of the respective packaging troughs 14' less the present product contents 22', and a partial volume V2', which is present above the respective packaging troughs 14' and is enclosed by the upper film 10'.

The total packaging volume P' is larger altogether than the total of the individual volumes included in the ultimately manufactured packages. The total packaging volume P' shown in FIG. 1 serves to distribute gas between the packages. This results in a certain gap S' between the upper and lower film material, through which the supplied gas can be distributed into all packages positioned inside the sealing station. However, when the total packaging volume is redensified, that is, when the upper film 10' is pressed downwards for the sealing process, visually unequally manufactured packages occur for the following reasons.

According to FIG. 1, the packages positioned inside the sealing station 3' are conventionally gassed to a gassing target pressure. For a sealing process for airtight sealing of the respective packages, the upper film material is pressed in the direction of the lower film material after the gassing process. As a result, the amount of gas contained in the partial volume V2' with the gassing target pressure is pressed into the partial volume V1' so that the pressure increases above the gassing target pressure in the partial volume V1'.

In addition, it may occur that due to a rapid downward movement of the upper film material, no gas compensation can take place between the individual packages positioned inside the sealing station.

Then, different pressure levels occur inside the individual packages that exceed the gassing target pressure so that the packaging appearances of the respective packages are not uniform.

In the event that a package has a high filling level (hereinafter also referred to as "filling degree"), the pressure in the package will be considerably higher than the gassing target pressure. After the sealing tool has been aerated to atmospheric pressure, such a package is inflated when the target gassing pressure initially generated in the total packaging volume approximately corresponds to the atmospheric pressure.

In the event that a package has a low filling degree or possibly is available as an empty package, the pressure before sealing hardly differs from the pressure that occurs during sealing in the package, since the pressure increase in the partial volume V1' is relatively small due to the pressing down of the upper film material. The consequence of this is that after aeration, the package is more likely to appear depressed if it was initially gassed to a gassing target pressure significantly below atmospheric pressure so that when packages with product content of target value are present, their packaging appearances look normal.

So far, attempts have been made to counteract the problems described above with a preset gassing offset pressure.

However, the use of a gassing offset pressure requires the knowledge of the filling degree of the packages to be closed, whereby it is assumed that the product line has a constant filling degree throughout the respective packages. It is therefore always problematic if the respective packages do not have a uniform filling degree. Despite the use of a gassing offset pressure, varying filling levels result in finished packages with different appearances.

With this approach, the gassing offset pressure previously had to be calculated manually and entered at the packaging machine as a calculation parameter so that its application is rather reserved for specially trained operating personnel.

The problem underlying the invention is to produce a method and a device for the manufacture of packages with packaging appearances being at least essentially similar to one another. This should be possible even if the respective packages have varying filling degrees, i.e. are filled voluminously unevenly. This problem is solved by the present invention

SUMMARY OF THE INVENTION

The invention relates to a method for operating a sealing station of a packaging machine, in particular a deep-drawing packaging machine. The method is configured to produce packages with packaging appearances or appearance being at least essentially similar to one another at possibly varying filling degrees. The method according to the invention may include the following steps: filling a packaging volume of at least one package positioned inside the sealing station with a gas intended for creating a desired atmosphere, to a preset gassing target pressure for a finished package, the package volume being enclosed between a lower and an upper packaging material; and discharging a partial amount of the gas introduced into the packaging volume from the packaging volume via a channel connected thereto into a collection volume linked thereto while retaining the packaging volume generated by the preceding filling so that inside the packaging volume, a pressure reduced relative to the gassing target pressure occurs for the remaining residual amount of the filled gas. The channel may also be referred to herein as a line.

Another embodiment of the present invention includes the steps of filling a packaging volume of at least one package positioned inside a sealing station by introducing a volume of gas to a preset gassing target pressure for a finished package to create a desired atmosphere, wherein the packaging volume is enclosed between a lower and an upper packaging material; discharging a partial amount of the volume of gas introduced into the packaging volume from the packaging volume into a collection volume in fluid communication with the packaging volume while maintaining the packaging volume generated by the preceding filling step so that completion of the discharging step creates an intermediate pressure inside the packaging volume, wherein the intermediate pressure is less than the gassing target pressure, and wherein a channel puts the packaging volume into fluid communication with the collection volume; wherein the discharged partial amount of the volume of gas substantially corresponds to a volume of the gas received within a theoretical partial volume of the packaging volume, wherein the theoretical partial volume is enclosed at least partially by a theoretical plane, wherein the theoretical plane crosses the packaging volume and occupies at least a portion of an edge of the lower packaging material and the upper packaging material; and reducing the packaging volume by the theoretical partial volume by moving at least a portion of the upper packaging material to an end position that substantially overlies the theoretical plane so that a final pressure inside the at least one package is substantially the gassing target pressure.

In one embodiment, the discharged partial amount of the gas may substantially correspond to the amount of the gas received within a theoretical partial volume of the packaging volume, which theoretical partial volume may be enclosed by a theoretical plane, the theoretical plane may cross the packaging volume and may occupy at least a part of an edge of the lower packaging material and the upper packaging material.

The method may also include the step of reducing the packaging volume maintained until then by the theoretical partial volume while moving the upper packaging material to an end position essentially falling to the theoretical plane so that the pressure inside the package increases again to the gassing target pressure.

The gassing target pressure initially generated in a respective working cycle in the packaging volume of the package(s) which has remained free of products may be lowered in a targeted manner to a lower pressure level while maintaining the packaging volume by discharging a detectable partial amount of the previously supplied gas so that during the subsequent, preferably slow, pressing down of the upper film material, a re-increase to the gassing target pressure is possible when the upper film material reaches the end position intended for completion of the package, i.e. the packaging volume may be reduced by the theoretical partial volume.

The filling of the packaging volume to the gassing target pressure as well as the targeted discharge of the partial amount of gas in order to create a reduced pressure level within the packaging volume may be detected using a pressure sensor connected to the packaging volume.

In one embodiment, the core of the invention may be to first gas the freely present packaging volume of one or more packages positioned in the sealing station (less the respective product volumes) to the gassing target pressure per working cycle, and then to discharge therefrom again a partial amount of the incoming gas from the theoretical partial volume, which can be predetermined according to physical principles and by which the packaging volume may be later reduced when the upper film material may be depressed.

The consequence of this may be that, contrary to an operation with a fixed preset gassing offset pressure per working cycle, a pressure-controlled gassing to the gassing target pressure adapted to the actually freely available packaging volume and a subsequent discharge of a partial amount of the supplied gas can take place over and over again so that the packaging appearance of finished packages, even with varying filling levels and/or empty packages, if any, are substantially identical to one another.

In one embodiment, the amount of gas in the partial volume may be discharged into the collection container, wherein this amount of gas would otherwise be compressed in a closed packaging volume in the prior packaging process as described above.

In one embodiment of the invention, the theoretical plane simultaneously forms a theoretical system boundary as a reference for the fact that the amount of gas contained above the system boundary after filling is to be discharged within the theoretical and calculable partial volume, whereby the pressure within the packaging volume decreases as an intermediate step. The subsequent volume reduction by lowering the upper film material to the system boundary then leads to the re-establishment of a gas atmosphere to the gassing target pressure level so that sealing can subsequently take place.

In other words, according to the invention, a filling of the respective packages to the gassing target pressure adapted to the respective filling degrees may be automatically simulated according to the invention by the fact that, in particular with filling degrees varying per working cycle, the amount of gas within the theoretical partial volume, which may be required at the beginning of the method as an aid for the gas distribution between the respective packages, may be discharged to the collection volume after the gassing process.

On the basis of physical principles according to Boyle-Mariott, the amount of gas contained within the theoretical, calculable partial volume at the gassing target pressure can be discharged quantitatively controlled into the known collection volume, which in turn has a definable initial pressure.

In one preferable embodiment, the partial amount of the gas discharged into the packaging volume via the channel may be conducted into a collection volume at least partially enclosed by a tool upper part of the sealing station and/or the upper packaging material. According to this variant, the collection volume may be provided directly in the tool upper part of the sealing station, and may be integrated into the upper part of the sealing station, which leads to an advantageous compact structure of the sealing station for the method according to the invention. In addition, the collection volume and the theoretical partial volume can be easily calculated on the basis of known geometries of the structure of the tool upper part, whereby the discharge of the partial amount of gas into the collection volume can be carried out without any technical problems.

An alternative embodiment of the invention provides that the partial amount of the gas discharged into the packaging volume via the channel may be conducted into a separate collection container forming the collection volume. Therefore, the collection container serves as a separate reference volume, whereby, if necessary, a format change as well as a possibly connected tool change can be carried out particularly easily without affecting the machine program.

In an advantageous embodiment, a target pressure for the collection volume may be determined on the basis of the partial amount of gas discharged, up to which point the channel remains open. Preferably, irrespective of the embodiment of the collection volume, the pressure prevailing in the collection volume may be detected by a pressure sensor connected to it. This would allow the discharge process to be precisely controlled and better integrated in a timed manner into further method steps. A preset time fixation, possibly resulting in "dead times", for discharging the partial amount of the gas may be then not necessary. A target pressure-based process control of the discharge process at the collection volume can be carried out very precisely using simple control and regulation technology, which possibly already exists at the machine, and leads to an optimization of the entire production process due to the associated minimization of dead times.

In one embodiment, the pressure generated within the collection volume by the gas introduced into it remains lower than the pressure applied within the packaging volume to the residual amount of gas remaining there during the entire discharge process so that the packaging volume remains stable even after the discharge process. This ensures high process stability, in particular high process manufacturing quality.

A preferred embodiment may provide that the upper packaging material may be moved into the end position using an aeration process and/or using at least one device performing a lifting movement. Ideally, such a process may be controlled in such a way that the upper packaging material may be slowly moved to the end position so that the residual amount of the filled gas remaining within the packaging volume after the discharge process can be distributed over all the packages positioned inside the sealing station. Therefore, the respective packages can be produced visually identical to each other.

In one embodiment, the upper packaging material may be sealed in the end position along an edge area with the lower packaging material so that the finished packages air-tightly enclose a desired atmosphere.

A preferred embodiment provides that the packaging volume may be evacuated before filling with gas. Thereby, a desired atmosphere can be created very exactly within the respective packages by the subsequent method steps.

In one embodiment, the theoretical partial volume and/or the collection volume, in particular their ratio to each other, are determined using a test run. For this purpose, for example, the lower packaging material could be flat, i.e. not formed, fed to the sealing station and clamped together with the upper packaging material. During gassing, only a space corresponding to the theoretical partial volume would be filled with an amount of gas to the gassing target pressure. If the channel is then opened until the pressure is equalized between the partial volume clamped in the sealing station and the collection volume, the volume ratio can be determined using the equalized pressure detected with prior knowledge of the total volume (consisting of the collection volume and the partial volume). Consequently, their respective volumes also result.

The method according to the invention may be used in the production of visually comparable packages with a predetermined approximately constant filling degree for the precise and simple automated determination of an offset pressure, wherein the offset pressure may be determined from a difference between the gassing pressure and the pressure still present within the packaging volume after the partial amount of gas from the theoretical partial volume has been discharged so that in subsequent machine cycles, the packaging volume may be only filled with gas until the pressure which results from the gassing target pressure less the determined offset pressure may be reached. Thus, insofar as the packages to be produced have the same filling degree with respect to each other as a prerequisite for the offset function, the method according to the invention could be advantageously used to determine the offset pressure at least at the beginning of the manufacturing process, while subsequently the discharge process may be dispensed with for this product batch.

This method to determine the offset pressure could also be repeated at intervals during production for the purpose of an offset pressure update, whereby the production quality may possibly be further improved.

The invention also relates to a sealing station for a packaging machine which may be provided in the form of a deep-drawing packaging machine, wherein the sealing station may comprise a channel which connects a packaging volume of at least one package positioned within the sealing station and having a collection volume enclosed between a lower and an upper packaging material, wherein the channel is intended for discharging a predetermined partial amount of a gas into the collection volume previously filled into the packaging volume.

In one embodiment, the entire packaging volume may be initially filled with a filling gas intended for a desired atmosphere to a target pressure, which is also to be subsequently enclosed in the finished, however, in terms of volume reduced packages. The initially filled packaging volume consists of a first partial volume formed by the spaces left free by the inserted products in the lower preformed packaging material and a second partial volume formed above the first partial volume and enclosed by the upper packaging material for the purpose of uniform gas distribution. The amount of gas contained in the second partial volume according to the invention may be discharged via the channel to the collection volume so that in the meantime the pressure prevailing in the maintained packaging volume decreases, but subsequently increases again to the originally generated target pressure by reducing the packaging volume by the second partial volume intended for gas distribution to the desired packaging dimension.

Using such a sealing station, packages can be produced with packaging appearances being at least substantially similar to one another at possibly varying filling degrees. Furthermore, the sealing station according to the invention may be suitable for carrying out a test run of the type described above.

The pressure level currently prevailing in the packaging volume may be measured for the purpose of gas supply and/or gas discharge control into the collection volume using a pressure sensor connected to the packaging volume. The channel may be preferably provided with a valve, in particular a 2/2-valve, which can be closed to limit the predetermined partial amount of the gas to be discharged to the collection volume. The valve can be process-controlled using pressure value detection in the collection volume so that a precise discharge of the partial amount of gas occurs. For this purpose, a pressure sensor may be connected to a section of the channel leading to the collection volume.

One embodiment provides that a volume flow can be controlled using the valve. This makes it possible to control the discharge process of the partial amount of gas with high process stability.

A preferable embodiment includes at least one section of the channel that may be further provided for evacuating and/or gassing the packaging volume. The channel thereby fulfils multiple functions and can be integrated in a compact way at the sealing station, if necessary on the basis of already existing channel systems.

A yet another embodiment, a particularly compact design exists when the collection volume may be formed within a tool upper part of the sealing station. Alternatively, the collection volume may be formed by a separate collection container of the sealing station. Other aspects and advantages of the present invention will be apparent from the following detailed description of the preferred embodiments and the accompanying drawing figures.

DESCRIPTION OF THE SEVERAL VIEWS OF THE DRAWINGS

In the following, an advantageous embodiment of the present invention will be explained in more detail making reference to a drawing, in which the individual figures show.

DETAILED DESCRIPTION OF THE INVENTION

Figure 1:
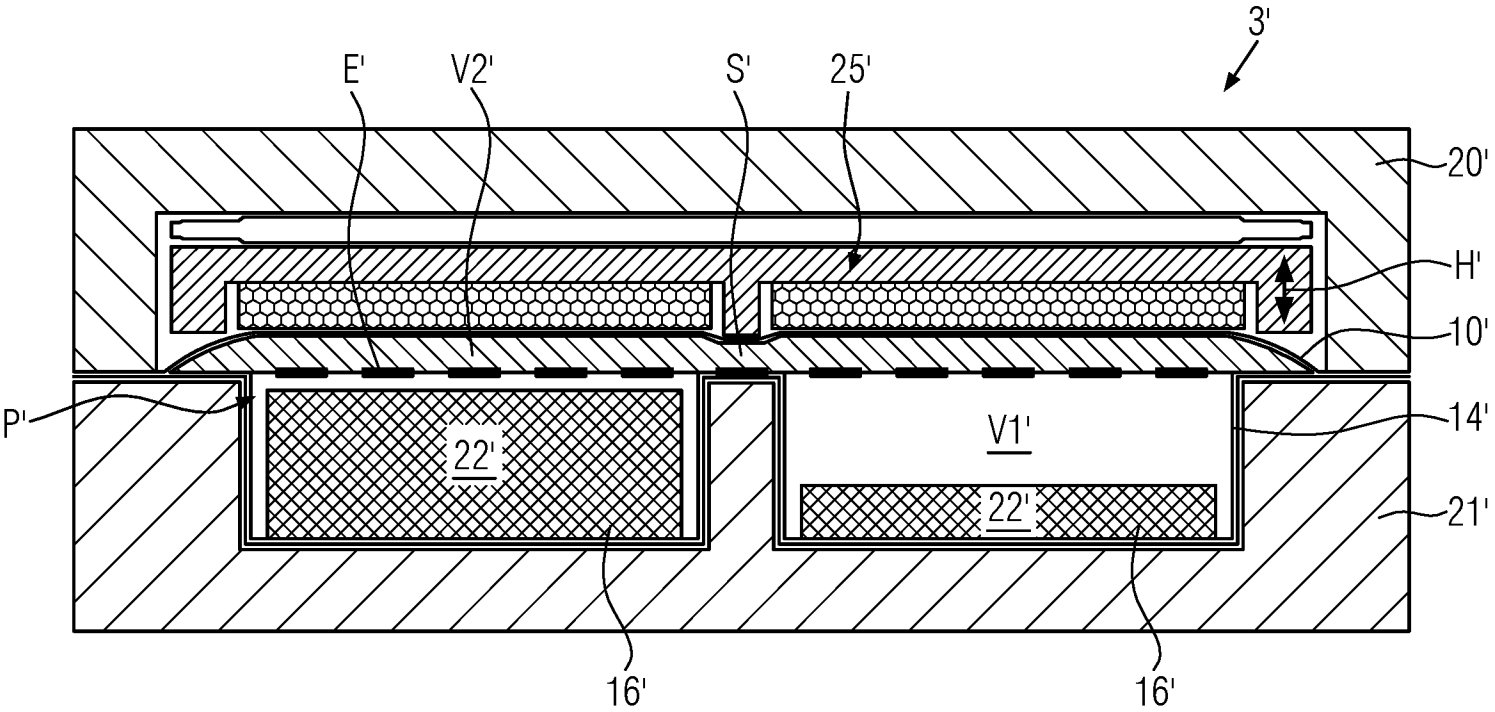
(PRIOR ART) FIG. 1
FIG. 1 is a schematic sectional drawing of a known embodiment of a sealing station without a gas discharge capability.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a schematic presentation of a sealing station 3' according to the prior state of the art.

The sealing station 3' has a tool upper part 20' and a tool lower part 21' which can be moved up to the tool upper part 20' using a lifting movement and which is configured to accommodate pre-formed packaging troughs 14'. In the packaging troughs 14' shown in FIG. 1, products 16' with different filling degrees 22' are accommodated.

Inside the sealing station 3', the packaging troughs 14' together with an upper film 10' enclose an airtight packaging volume P' which consists of a partial volume V1' and a partial volume V2'. The partial volume V1' is composed of the sum of the respective packaging trough volumes created by the packaging troughs 14' and released by the products 16'. The partial volume V2' forms a theoretical partial volume, which is enclosed between the upper film 10' and a theoretical plane E' which is represented by a dotted line. Based on the partial volume V2', a connecting gap S' is formed above the two packaging troughs 14', which allows the gas to be distributed within the packaging volume P', particularly during the filling process.

According to FIG. 1, a sealing unit 25' for a sealing process is positioned inside the tool upper part 20', which is configured to move the upper film 10' for a sealing process in the direction of the packaging troughs 14' positioned below using a lifting movement H'.

In the embodiment shown in FIG. 1, the packaging volume P', consisting of the sum of the respective partial volumes V1' and V2', is initially filled to a gassing target pressure $p_{soll}'$ with a gas to create a desired atmosphere. By the subsequent lifting movement H' of the sealing unit 25', the gas amount contained in the partial volume V2' is pressed into the partial volume V1' released by the products 16' within the packaging troughs 14'. Since the respective filling degrees 22' of the packaging troughs 14' are different, the final pressure inside the finished packages V is also different. This leads to the fact that packages V cannot be produced with packaging appearances which are at least essentially similar to one another.

Figure 2:
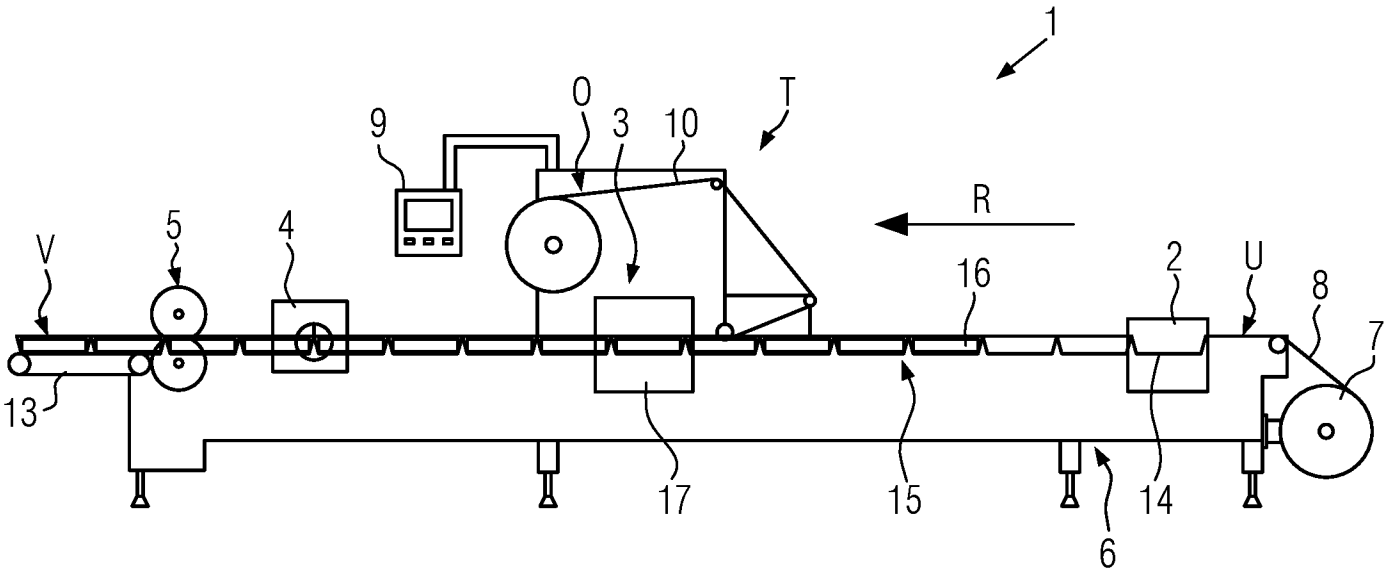
FIG. 2 is a schematic side view of one embodiment of a packaging machine in accordance with the teachings of the present disclosure, which is configured in the form of a deep-drawing packaging machine and comprises a sealing station with one embodiment of a gas discharge function according to the teachings of the present disclosure.

FIG. 2 shows a schematic view of a packaging machine 1 of the present invention, which is configured in the form of a deep-drawing packaging machine T. The packaging machine 1 has a forming station 2, a sealing station 3, a cross cutting device 4 as well as a longitudinal cutting device 5. These are arranged in this order in a working direction R on a machine frame 6.

On the machine frame 6 of the packaging machine 1, a feed roller 7 is arranged on the input side, from which a lower film U is drawn off as the lower packaging material 8. The lower film U is transported into the forming station 2 using a feed device which is not shown. Using a deep-drawing process taking place there, packaging troughs 14 are formed into the lower film U using the forming station 2. The packaging troughs 14 are then further transported to an infeeding stretch 15, where they can be filled manually or automatically with a product 16. Following the infeeding stretch 15, the packaging troughs 14 filled with the products 16 are further transported to the sealing station 3. Using the sealing station 3, the packaging troughs 14 can be sealed with an upper film O, which forms an upper packaging material 10 so that by sealing the upper film O onto the packaging troughs 14, sealed packages V are produced, which can be separated with the cross cutting device 4 and the longitudinal cutting device 5 and transported away using a discharge device 13.

Figure 3:
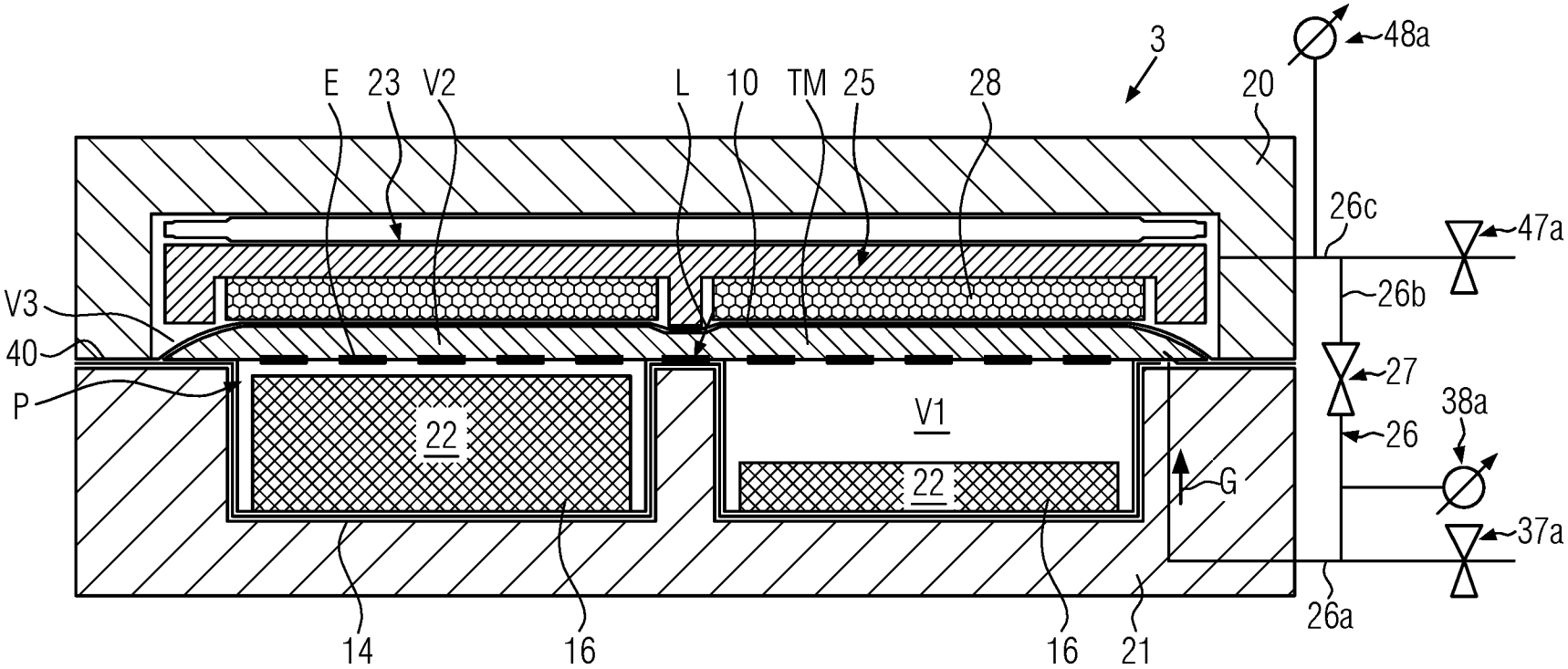
FIG. 3 is a schematic sectional drawing of one embodiment of a sealing station in accordance with the teachings of the present disclosure.

FIG. 3 schematically shows a sealing station 3 according to the invention as it can be used on the packaging machine 1 shown in FIG. 2.

The sealing station 3 according to the invention includes a tool upper part 20 as well as a tool lower part 21, which enclose a sealing chamber 23. FIG. 3 further shows that two packaging troughs 14 with respective products 16 are accommodated in the tool lower part 21, whereby the respective filling degrees 22 of the packaging troughs 14 differ.

The packaging troughs 14 accommodated inside the sealing station 3, together with the upper film O arranged above them, enclose a packaging volume P. The packaging volume P is traversed using a theoretical plane E represented by a dotted line, whereby it is divided into a partial volume V1 and a partial volume V2. The packaging trough 14 on the right viewed at image plane with a lower filling degree 22 forms a larger proportion of the packaging volume P than the other packaging trough 14 filled with a higher filling degree 22.

According to FIG. 3, the partial volume V2 enclosed by the upper film O and the theoretical plane E is connected via a channel 26 to a collection volume V3 integrated in the tool upper part 20, which is enclosed between the tool upper part 20 and the upper film O.

According to FIG. 3, the packaging volume P is filled with a gas G via a section 26*a* of the channel 26 to create a desired atmosphere at a gassing target pressure $p_{soll}$. For the filling process, section 26*a* comprises an inlet valve 37*a* controlled by a pressure sensor 38*a*. The pressure sensor 38*a* is configured to detect the pressure level within the packaging volume P.

Subsequently to this, a partial amount TM (see FIG. 5) contained within the partial volume V2 of the gas G brought to the gassing target pressure $p_{soll}$ is again taken from the packaging volume P via the channel 26. Thereby, the gas G is led into the collection volume V3 via sections 26*a*, 26*b*, and 26*c* of the channel 26. The partial amount TM of the discharged gas G corresponds to the amount of the gas contained in the partial volume V2. For the discharge process, section 26*b* comprises a (discharge) valve 27 controllable by another pressure sensor 48*a*. The pressure sensor 48*a* is configured to detect the pressure level within the collection volume V3.

Section 26*c* is simultaneously provided as an aeration channel with an aeration valve 47*a*.

Due to the discharging of the partial amount TM, the amount of gas originally introduced during the preceding filling process is reduced to a residual amount RM of the gas G which is shown below in connection with FIG. 5 and which remains in the packaging volume P, whereby the initially prevailing gassing target pressure $p_{soll}$ decreases to a lower pressure level pred.

After the discharged partial amount TM of the gas G has been taken up by the collection volume V3, the packaging volume P, i.e. the valve 27 of the discharge channel 26, is closed and the upper film O is pressed in the direction of the packaging troughs 14 positioned below using the sealing unit 25. The upper film O is brought into an end position L positioned according to the theoretical plane E, in which the upper film O is sealed onto the packaging troughs 14.

Due to the lowering of the upper film O, the gas G contained in the partial volume V2 is pressed into the partial volume V1. As a result, the reduced pressure $p_{red}$ set within the packaging volume P during the discharge process increases again to the gassing target pressure $p_{soll}$.

Lowering of the upper film O can be controlled in such a slow manner using the sealing unit 25, in particular a device 28 which can be lowered on it and is formed plate-like, and/or using an aeration process so that the remaining amount RM contained within the packaging volume P is distributed slowly over the respective packages V. The device 28 is configured as a product protection plate and is configured to prevent unwanted heat from being transferred to the products 16 accommodated inside the packaging troughs 14 during the sealing process.

Figure 4:
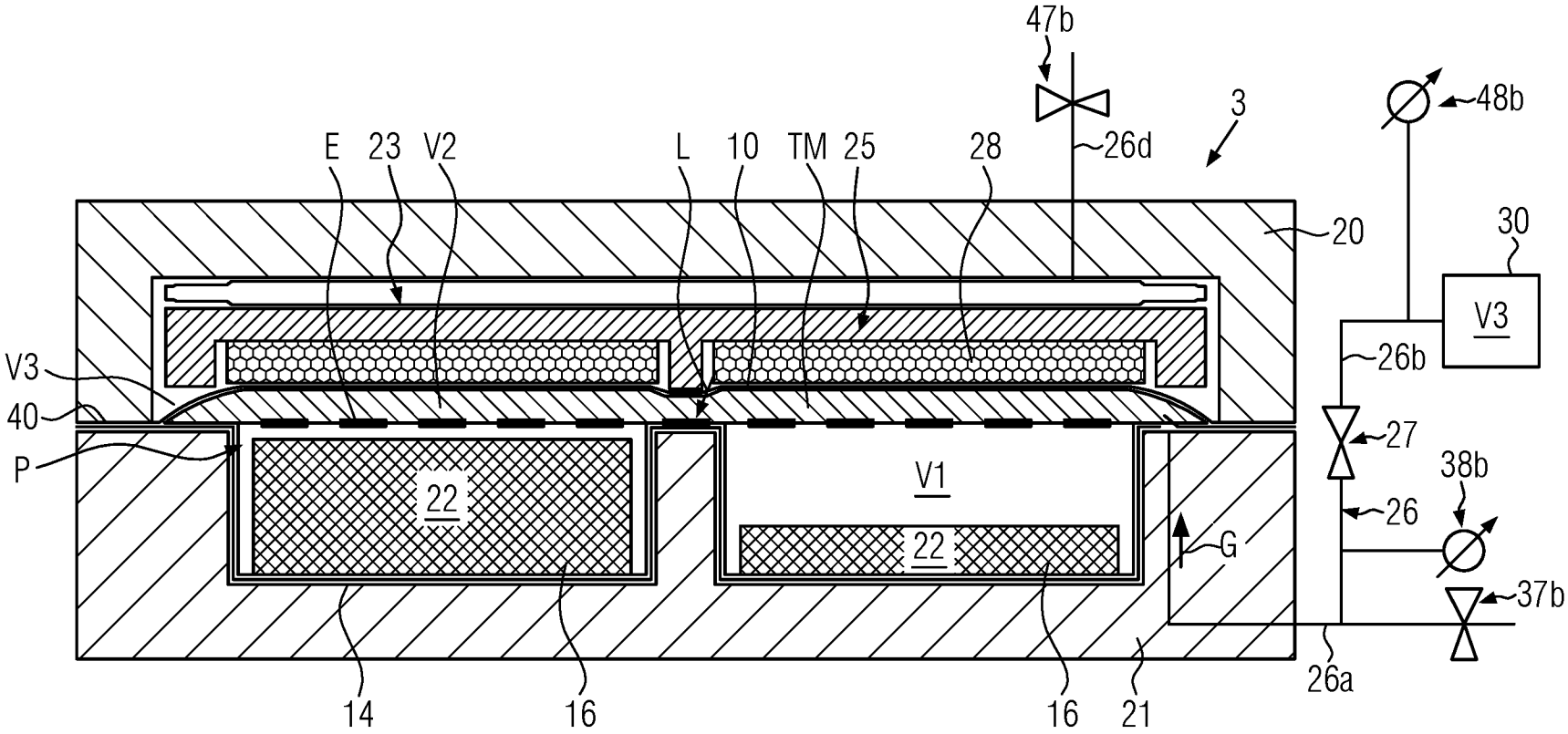
FIG. 4 is a schematic sectional drawing of one embodiment of a sealing station in accordance with the teachings of the present disclosure showing a collection volume formed by a separate collection container.

FIG. 4 shows the sealing station 3 according to FIG. 3, whereby a separate collection container 30 is used as collection volume V3. In addition, a separate aeration channel 26*d* is connected to the sealing chamber 23, which comprises an aeration valve 47*b*.

In FIGS. 3 and 4, the channel 26 in its section 26*b* comprises the valve 27, which is opened for the discharge process so that the partial amount TM of the gas G can flow from the packaging volume P into the collection volume V3. Insofar as using the section 26*a* filling of the packaging volume P or using the section 26*c* aeration of the sealing chamber 23 takes place, the valve 27 remains closed. In addition, the valve 27 remains closed when an evacuation of the packaging volume P takes place prior to the filling process.

The discharge process via the valve 27 according to FIG. 4 can be controlled using a pressure sensor 48*b* connected to the collection volume V3. The filling process takes place via an inlet valve 37*b* which is pressure-controlled using a pressure sensor 38*b* connected to the packaging volume P.

For further transport of sealed packages V out of the sealing station 3, the tool upper part 20 is aerated via section 26*c* of FIG. 3 or via the separate aeration channel 26*d* of FIG. 4 (i.e. creating a pressure equalization to the atmospheric pressure of the environment).

Figure 5:
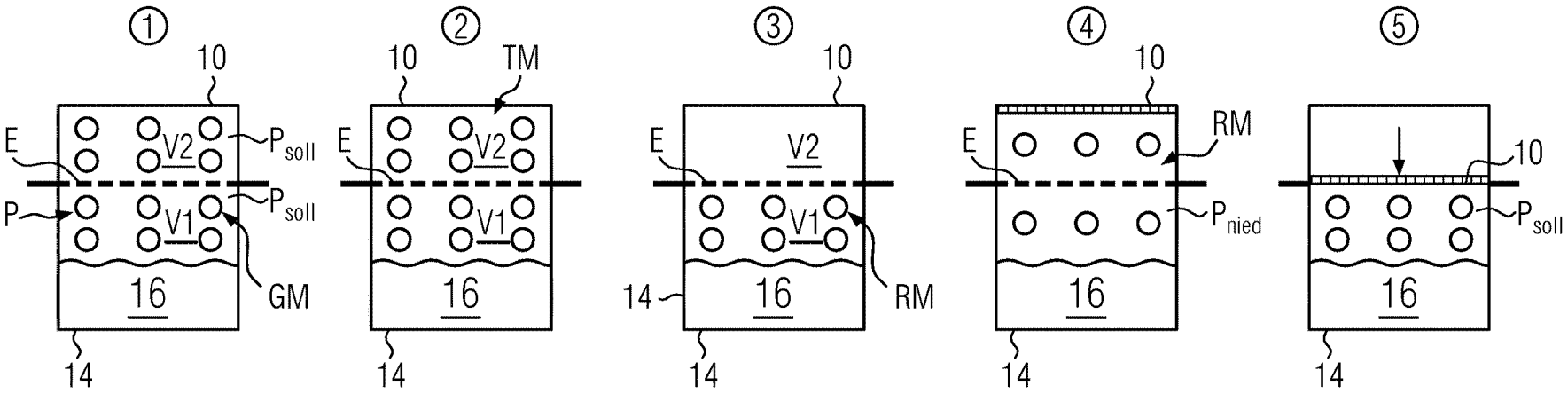
FIG. 5 is a schematic drawing showing the principles and sequencing of one embodiment of the present invention.

FIG. 5 shows the principle of the method according to the invention.

In a first method step, the packaging volume P is filled with the desired gas G to the gassing target pressure $p_{soll}$. There is then a predetermined amount of gas GM in the packaging volume P corresponding to the gassing target pressure $p_{soll}$.

In the second and third method steps, the gas amount (partial amount TM) contained within the theoretical partial volume V2, which is present above the theoretical plane E drawn in as the system boundary, is discharged via the channel 26 shown in FIGS. 3 and 4.

Accordingly, according to the fourth method step, the residual amount RM of the gas G remaining within the packaging volume P is distributed over the entire packaging volume P so that a reduced pressure level $p_{red}$ is applied within the maintained packaging volume P.

Finally, in the fifth method step, the packaging volume P is reduced by the theoretical partial volume V2 by pressing the upper packaging material down into the end position L, which drops to the theoretical level E. The gassing target pressure $p_{soll}$ within the partial volume V1 intended for finished packaging V is now present again. According to this process, packaging with packaging appearances being at least essentially similar to one another can be produced irrespective of the filling degree.

As the basis for the method according to the invention it is assumed that the sum of the theoretical partial volume V2 with the collection volume V3 is geometrically known.

Using a test run which can be carried out using the sealing station 3 according to the invention, the ratio of the partial volume V2 and the collection volume V3 can be determined. The test run could, for example, be carried out in such a way that the lower film U used for the packaging troughs 14 is not inserted into the sealing station 3 in a shaped form and is fixed there together with the upper film O. During gassing, therefore, only the partial volume V2 is gassed to the gassing target pressure $p_{soll}$. If the channel 26 is then opened and left open until a pressure equalization between the partial volume V2 and the collection volume V3 has been reached, the ratio of the partial volume V2 to the collection volume V3 can be calculated using the pressure that occurs. Via the total volume, consisting of the partial volume V2 and the collection volume V3, the respective volumes of the partial volume V2 and the collection volume V3 can be directly calculated.

Alternatively, the partial volume V2 could also be estimated approximately via an executed lifting of the sealing unit 25. Further alternatively, the respective volumes V2 and V3 could also be calculated using clearly known reference volumes when commissioning the machine. The volumes used in connection with the principle according to the invention, that is, the partial volume V2 as well as the collection volume V3, can be conveniently stored in a tool database of the packaging machine 1 and serve as calculation variables during the packaging process.

Insofar as a constant filling degree of the packages V to be closed is expected, for example, because the same intersection of a selected product 16, for example sliced sausage or sliced cheese, is always present in the respective packaging troughs, the principle according to the invention can be used for the automated generation of an offset pressure so that the discharge process of the partial amount of the gas can be dispensed with by using the offset pressure, in order to produce packages with essentially constant packaging appearances.

Thereby, it is only gassed to a reduced pressure, which results from the gassing target pressure less the offset pressure calculated on the basis of the invention, and sealed immediately afterwards. In order to check the correctness of the offset pressure, it could be provided that this is calculated several times during a product batch repeatedly using the principle according to the invention.

The invention could just as easily be carried out at a sealing station which is part of a packaging machine which is not configured as a deep-drawing packaging machine, for example a tray sealing machine with feeding of pre-fabricated packaging trays.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A method for operating a sealing station of a packaging machine for producing packages with packaging appearances being at least essentially similar to one another even if the packages have varying filling degrees, the method comprising the following steps:

filling a packaging volume of at least one package positioned inside a sealing station by introducing an amount of gas to a preset gassing target pressure for a finished package to create a desired atmosphere, wherein the packaging volume is enclosed between a lower packaging material and an upper packaging material;

discharging a partial amount of the amount of gas introduced into the packaging volume from the packaging volume into a collection volume in fluid communication with the packaging volume while maintaining the packaging volume generated by the preceding filling step so that completion of the discharging step creates an intermediate pressure inside the packaging volume, wherein the intermediate pressure is less than the gassing target pressure, and wherein a channel puts the packaging volume into fluid communication with the collection volume;

wherein the discharged partial amount of gas substantially equals an amount of the gas received within a theoretical partial volume of the packaging volume, wherein the theoretical partial volume is defined at least partially by a theoretical plane, which crosses the packaging volume and occupies an edge of the lower packaging material, and by the upper packaging material; and reducing the packaging volume by the theoretical partial volume by moving the upper packaging material to an end position that substantially overlies the theoretical plane so that a final pressure inside the at least one package is substantially the gassing target pressure.

2. The method according to claim 1, wherein the discharging the partial amount step comprises discharging the partial amount of gas through the channel into the collection volume and wherein the collection volume is at least partially defined by at least one of a tool upper part of the sealing station and the upper packaging material.

3. The method according to claim 1, wherein the discharging the partial amount step comprises discharging the partial amount of gas through the channel into the collection volume and wherein the collection volume is a separate collection container.

4. The method according to claim 1, further comprising determining a target pressure of the collection volume using the discharged partial amount of gas, and keeping open the channel until a pressure inside the collection volume reaches the target pressure of the collection volume.

5. The method according claim 4, wherein the pressure generated inside the collection volume created by the discharged partial amount of gas remains lower than the intermediate pressure within the packaging volume to maintain the packaging volume during the discharge process.

6. The method according to claim 1, wherein the upper packaging material is moved into the end position using one of an aeration process or at least one device executing a lifting movement.

7. The method according to claim 1, wherein the upper packaging material is sealed with the lower packaging material at the end position.

8. The method according to claim 1, further comprising evacuating the packaging volume prior to the step of filling the packaging volume of the at least one package positioned inside the sealing station by introducing the amount of gas to the preset gassing target pressure for the finished package.

9. The method according to claim 1, further comprising the step of determining at least one of the theoretical partial volume and the collection volume using a test run of the sealing station.

10. The method according to claim 1, wherein the method is used in the production of packages having a predetermined filling degree which remains approximately the same, and further comprising determining an offset pressure from a difference between the gassing target pressure and the intermediate pressure which is still present within the packaging volume after the partial amount of the gas has been discharged from the packaging volume, and introducing a second amount of gas into a packaging volume of at least one other package positioned inside the sealing station in a subsequent machine cycle, wherein the second amount of gas is based on the difference between the gassing target pressure and the intermediate pressure.

11. A method for operating a sealing station of a packaging machine for producing packages with packaging appearances being at least similar to one another even if the packages have varying filling degrees, the method comprising the following steps:

filling a packaging volume, enclosed between a lower packaging material and an upper packaging material, of at least one package positioned inside the sealing station, with a gas intended for creating a desired atmosphere to a preset gassing target pressure for a finished package;

discharging a partial amount of the gas introduced into the packaging volume from the packaging volume via a channel connected thereto into a collection volume linked thereto while retaining the packaging volume generated by the preceding filling so that inside the packaging volume, a pressure reduction relative to the gassing target pressure occurs for a remaining residual amount of the filled gas;

wherein the discharged partial amount of the gas substantially corresponds to an amount of the gas received within a theoretical partial volume of the packaging volume, which theoretical partial volume is at least partially defined by a theoretical plane, which crosses the packaging volume and which occupies an edge of the lower packaging material, and by the upper packaging material; and reducing the packaging volume by the theoretical partial volume while moving the upper packaging material to an end position essentially falling to the theoretical plane so that pressure inside the at least one package increases again to the gassing target pressure.

12. The method according to claim 11, wherein the collection volume is at least partially defined by at least one of a tool upper part of the sealing station or the upper packaging material.

13. The method according to claim 11, wherein the collection volume is a collection container that is separate from an upper tool part and a lower tool part of the sealing station.

14. The method according to claim 11, further comprising determining a target pressure of the collection volume using the discharged partial amount of the gas, and keeping open the channel until a pressure inside the collection volume reaches the target pressure of the collection volume.

15. The method according claim 11, wherein a pressure generated inside the collection volume created by the discharged partial amount of the gas remains lower than a pressure within the packaging volume during the discharge process to retain the packaging volume during the discharge process.

16. The method according to claim 11, wherein the upper packaging material is moved into the end position using one of an aeration process or at least one device executing a lifting movement.

17. The method according to claim 11, wherein the upper packaging material is sealed with the lower packaging material at the end position.

18. The method according to claim 11, further comprising evacuating the packaging volume prior to the step of filling the packaging volume.

19. The method according to claim 11, further comprising determining at least one of the theoretical partial volume or the collection volume using a test run of the sealing station.

* * * * *